US007198118B2

(12) United States Patent
Hall et al.

(10) Patent No.: US 7,198,118 B2
(45) Date of Patent: Apr. 3, 2007

(54) COMMUNICATION ADAPTER FOR USE WITH A DRILLING COMPONENT

(75) Inventors: David R. Hall, Provo, UT (US); David S. Pixton, Lehi, UT (US); H. Tracy Hall, Jr., Provo, UT (US); Kline Bradford, Orem, UT (US); Michael Rawle, Springville, UT (US)

(73) Assignee: IntelliServ, Inc., Provo, UT (US)

( * ) Notice: Subject to any disclaimer, the term of this patent is extended or adjusted under 35 U.S.C. 154(b) by 367 days.

(21) Appl. No.: 10/878,192

(22) Filed: Jun. 28, 2004

(65) Prior Publication Data

US 2005/0284662 A1 Dec. 29, 2005

(51) Int. Cl.
*E21B 7/00* (2006.01)

(52) U.S. Cl. ..... 175/40; 175/320

(58) Field of Classification Search ..... 175/40, 175/320; 166/65.1, 66.5
See application file for complete search history.

(56) References Cited

U.S. PATENT DOCUMENTS

| | | | |
|---|---|---|---|
| 2,414,719 | A | 1/1947 | Cloud |
| 3,518,608 | A | 6/1970 | Papadopoulos |
| 4,739,325 | A | 4/1988 | MacLeod |
| 4,788,544 | A | 11/1988 | Howard |
| 6,012,015 | A | 1/2000 | Tubel |
| 6,173,793 | B1 | 1/2001 | Thompson et al. |
| 6,252,518 | B1 | 6/2001 | Laborde |
| 6,308,137 | B1 | 10/2001 | Underhill et al. |
| 6,392,317 | B1 | 5/2002 | Hall et al. |
| 6,670,880 | B1 | 12/2003 | Hall et al. |
| 6,688,396 | B2 | 2/2004 | Floerke et al. |
| 6,717,501 | B2 | 4/2004 | Hall et al. |
| 6,799,632 | B2 | 10/2004 | Hall et al. |
| 6,821,147 | B1 | 11/2004 | Hall et al. |
| 6,830,467 | B2 | 12/2004 | Hall et al. |
| 6,844,498 | B2 | 1/2005 | Hall et al. |
| 6,866,306 | B2 | 3/2005 | Boyle et al. |
| 6,888,473 | B1 | 5/2005 | Hall et al. |
| 6,913,093 | B2 | 7/2005 | Hall et al. |
| 6,929,493 | B2 | 8/2005 | Hall et al. |
| 6,945,802 | B2 | 9/2005 | Hall et al. |
| 6,968,611 | B2 | 11/2005 | Hall et al. |
| 2004/0039468 | A1 | 2/2004 | Lilly et al. |
| 2004/0104797 | A1 | 6/2004 | Hall et al. |
| 2004/0113808 | A1 | 6/2004 | Hall et al. |
| 2004/0145492 | A1 | 7/2004 | Hall et al. |
| 2004/0150532 | A1 | 8/2004 | Hall et al. |
| 2004/0164833 | A1 | 8/2004 | Hall et al. |

(Continued)

OTHER PUBLICATIONS

PCT/US 03/16475, Published Dec. 4, 2003, Applicant Baker Hughes; International Search Report: "Documents Considered to Be Relevant".

*Primary Examiner*—William P. Neuder
(74) *Attorney, Agent, or Firm*—Tyson J. Wilde; Jeffery E. Daly

(57) ABSTRACT

A communication adapter is disclosed that provides for removable attachment to a drilling component when the drilling component is not actively drilling and for communication with an integrated transmission system in the drilling component. The communication adapter comprises a data transmission coupler that facilitates communication between the drilling component and the adapter, a mechanical coupler that facilitates removable attachment of the adapter to the drilling component, and a data interface.

33 Claims, 7 Drawing Sheets

U.S. PATENT DOCUMENTS

2004/0164838 A1 8/2004 Hall et al.
2004/0216847 A1 11/2004 Hall et al.
2004/0244916 A1 12/2004 Hall et al.
2004/0244964 A1 12/2004 Hall et al.
2004/0246142 A1 12/2004 Hall et al.
2005/0001735 A1 1/2005 Hall et al.
2005/0001736 A1 1/2005 Hall et al.
2005/0001738 A1 1/2005 Hall et al.
2005/0035874 A1 2/2005 Hall et al.
2005/0035875 A1 2/2005 Hall et al.
2005/0035876 A1 2/2005 Hall et al.
2005/0036507 A1 2/2005 Hall et al.
2005/0039912 A1 2/2005 Hall et al.
2005/0045339 A1 3/2005 Hall et al.
2005/0046586 A1 3/2005 Hall et al.
2005/0048590 A1 3/2005 Hall et al.
2005/0067159 A1 3/2005 Hall et al.
2005/0070144 A1 3/2005 Hall et al.
2005/0082092 A1 4/2005 Hall et al.
2005/0092499 A1 5/2005 Hall et al.
2005/0092523 A1* 5/2005 McCaskill et al. ..... 175/38
2005/0093296 A1 5/2005 Hall et al.
2005/0095827 A1 5/2005 Hall et al.
2005/0115717 A1 6/2005 Hall et al.
2005/0145406 A1 7/2005 Hall et al.
2005/0150653 A1 7/2005 Hall et al.
2005/0161215 A1 7/2005 Hall et al.
2005/0173128 A1 8/2005 Hall et al.
2005/0212530 A1 9/2005 Hall et al.
2005/0236160 A1 10/2005 Hall et al.
2005/0279508 A1 12/2005 Hall et al.
2005/0284659 A1 12/2005 Hall et al.
2005/0284662 A1 12/2005 Hall et al.
2005/0284663 A1 12/2005 Hall et al.
2005/0285645 A1 12/2005 Hall et al.
2005/0285705 A1 12/2005 Hall et al.
2005/0285706 A1 12/2005 Hall et al.
2005/0285751 A1 12/2005 Hall et al.
2005/0285752 A1 12/2005 Hall et al.
2005/0285754 A1 12/2005 Hall et al.

* cited by examiner

COMMUNICATION ADAPTER FOR USE WITH A DRILLING COMPONENT

FERDERAL SPONSORSHIP

This invention was made with government support under contract No. DE-FC26-01NT41229 awarded by the Department of Energy. The government has certain rights in this invention.

CROSS-REFERENCE TO RELATED APPLICATIONS

None

BACKGROUND OF THE INVENTION

This invention relates to communicating with transmission systems in drilling components, specifically referring to communicating with transmission systems when the drilling components are not actively drilling. The oil drilling industry has long sought to retrieve downhole information at faster rates while drilling. U.S. Pat. No. 6,670,880, which is incorporated herein by reference, discloses a downhole transmission system that transmits data through a plurality of downhole components in a drill string. Each component has a first and a second end, the first end of one component being adapted to connect to the second end of an adjacent component. The preferred embodiment disclosed in this patent operates in connection with double-shouldered tool joints in the downhole components, with transmission elements located in the secondary shoulder at each end of each component. A coaxial cable housed inside each component extends the length of the component, enabling the transmission elements at each end to communicate with each other. When the string of components is made up the transmission elements of adjacent first and second ends couple together to complete the transmission system.

During drilling a rotary connector permits communication between the downhole transmission system of the '880 patent with surface equipment. The rotary connector may replace the saver sub that is frequently interposed between the threaded portion of the top drive or kelly and the drill string so as to save the threads of the top drive or kelly from excessive wear. During tripping the rotary connector is disconnected from the drill string, resulting in loss of communication between the surface equipment and the drill string. It is desirable for the drilling crew to have access to the downhole information while tripping. In this specification, tripping is defined as the set of operations associated with removing or replacing an entire string or a portion thereof from the hole. Tripping is necessary for a number of well operations that change the configuration of the bottom-hole assembly, such as replacing the bit, adding a mud motor, or adding measurement while drilling (MWD) or logging while drilling (LWD) tools. Tripping can take many hours, depending on the depth to which drilling has progressed. The ability to maintain communication with downhole tools and instruments during tripping can enable a wide variety of MWD and LWD measurements to be performed during time that otherwise would be wasted. This ability can also enhance safety. For instance, in the event that a pocket of high-pressure gas breaks through into the well bore, the crew can be given critical advance warning of a dangerous "kick," and timely action can be taken to protect the crew and to save the well. Maintaining communication during tripping can also give timely warning of lost circulation or of other potential problems, enabling timely corrective action.

SUMMARY OF THE INVENTION

The invention is directed to a communication adapter for removable attachment to a drilling component when the drilling component is not actively drilling, thereby enabling communication with an integrated transmission system in the drilling component. The communication adapter comprises a data transmission coupler for allowing data communications between the drilling component and the adapter, a mechanical coupler for removably attaching the adapter to the drilling component, and a data interface.

As the phrase is used herein, a drilling component is "not actively drilling" whenever the drilling component is not advancing a drill bit into a subterranean formation. Active drilling will cease, for example, while tripping or while taking wireline measurements.

The data interface is preferably an interface to surface equipment. The surface equipment may comprise a computer or a communications server or switch. The data interface may communicate with the surface equipment by any known means, such as by microwaves, radio waves, acoustic waves, light waves, electrical conductors, or fiber optics. The surface equipment may also be connected to a local area network (LAN) that makes data accessible to local workstations, and it may also connect with a wide-area network (WAN), that connects with off-site locations, for example, through the internet. The surface equipment computer may store, process, and communicate information received from downhole elements, and it may also send control signals through the downhole network to direct the activities of downhole elements. Another embodiment of the present invention may comprise a data interface located directly on the communication adapter, thereby enabling direct communication with the rig crew as they work on the rig floor. The data interface may comprise a light, a gauge, a speaker, a display screen or other similar devices.

A transmission coupler in the communication adapter is adapted to communicate with the integrated transmission system in the drilling component. Preferably, the transmission coupler is an inductive coupler. More preferably, the inductive coupler comprises a ferrite trough. Another alternative for a transmission coupler is a direct electrical coupler. An embodiment of the direct electrical coupler comprises a metal-to-metal connection. Another embodiment of the transmission coupler is a capacitive coupler.

Preferably, the transmission system in the drilling component is an integrated transmission network, wherein the communication elements are integral with the downhole drilling components. The integrated transmission network comprises transmission couplers located in both ends of the drilling components that are coupled to each other within each component by means of a coaxial cable housed inside the component and extending the length of the drilling component. The transmission coupler is adapted to pass a signal from one drilling component to another. In another embodiment of the present invention, the drilling component is separated from the drill string and the communication adapter is utilized for checking the communication integrity of the drilling component prior to its placement in the drill string. A separated drilling component may be a single drilling component, or it may be a multiplicity of components forming a segment of the drill string, such as a stand of two or three connected drill pipes or drill collars.

In one embodiment of the present invention, the drilling component is attached to a drill string. Preferably, the mechanical coupler comprises a threaded portion that engages a threaded portion on the drilling component. Another embodiment of the present invention utilizes a mechanical coupler comprising a locking mechanism, a magnet, a cam, or a clamp. Embodiments of the mechanical coupler are adapted to couple either to the pin end or the box end of the drilling component.

The drilling component that is connected to the drill string may comprise a drill pipe, a heavyweight drill pipe, a drill collar, a stabilizer, a kelly, or any downhole tool. Examples of downhole tools include mud motors, turbines, jars, communications repeaters, mud hammers, shock absorbers, reamers, under-reamers, fishing tools, steering elements, MWD tools, LWD tools, seismic sources/receivers and other such devices.

The communication adapter is preferably capable of transmitting both data signals and power. The communication adapter may also seal to the uppermost component of the drill string and may be provided with means to prevent or regulate the escape of fluids or gases from the string.

DETAILED DESCRIPTION OF THE PREFERRED EMBODIMENTS

The disclosed description is meant to illustrate the present invention and not to limit its scope. Other embodiments of the present invention are possible within the scope and spirit of the claims.

Figure 1:
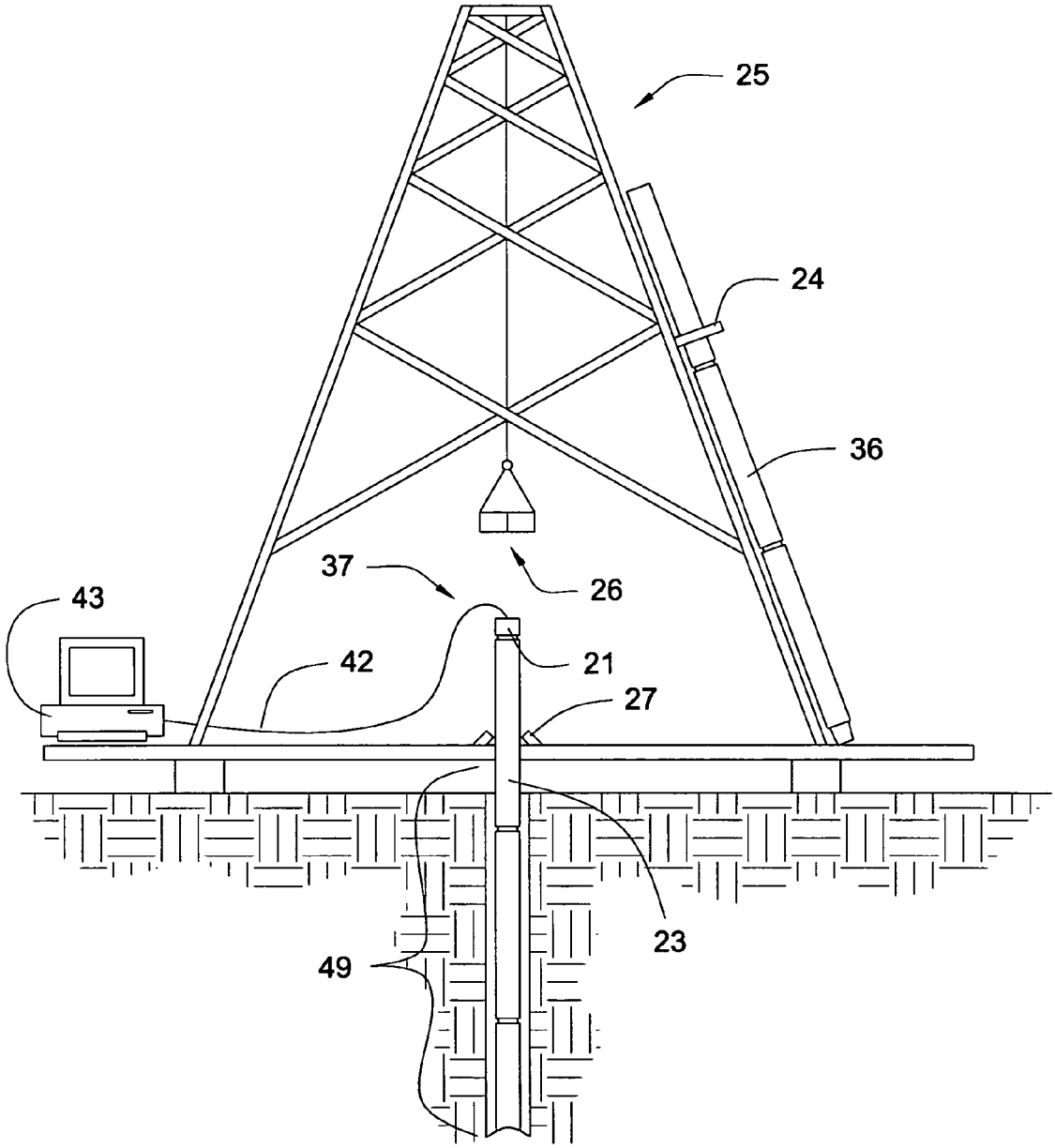
FIG. 1 is a partial sectional view of an embodiment of the invention in operation with a drill string.

Referring to FIG. 1, the communication adapter 37 of the invention is shown in operation on a derrick or drill rig 25. During drilling a rotary connector, not shown, establishes communication between the surface equipment 43 and the drill string 49. The rotary connector is often disconnected during pauses in the drilling, for example, while tripping the string into or out of the well. The derrick 25 supports the elevator 26 that hoists the drill string 23. Usually two or three drilling components 23 forming a segment 36 of the drill string 49 are added to or removed from the drill string as a single assembly or stand. These may be leaned against the side of the derrick 25, retained by a fingerboard 24.

During tripping or during other pauses in the drilling, the drill string 49 is suspended in the well from slips 27. In order to establish communication between the surface equipment 43 and the integrated transmission system of the drill string 49, the communication adapter 37 is attached to the uppermost drilling component 23. A cable 42 communicates between the communication adapter 37 and surface equipment 43. The adapter 37 is designed so that it does not interfere with the attachment of the elevator 26 to the uppermost drilling component 23 in the drill string 49. Most preferably it is quickly and easily attached to and removed from component 23, thereby facilitating nearly-continuous communication while tripping.

Figure 2:
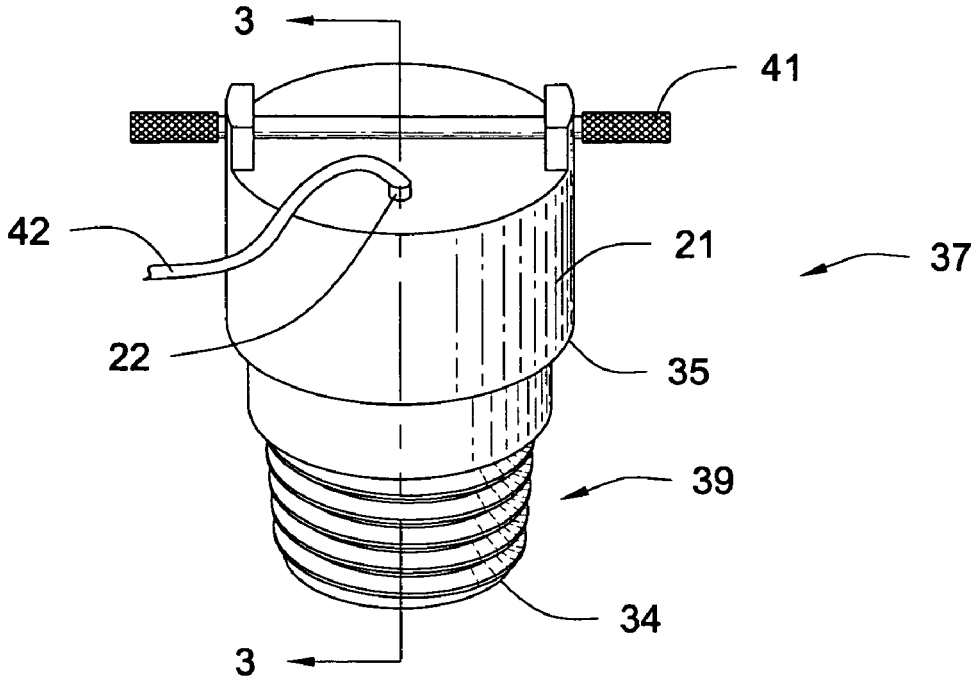
FIG. 2 is a perspective view of an embodiment of a communication adapter.
Figure 3:
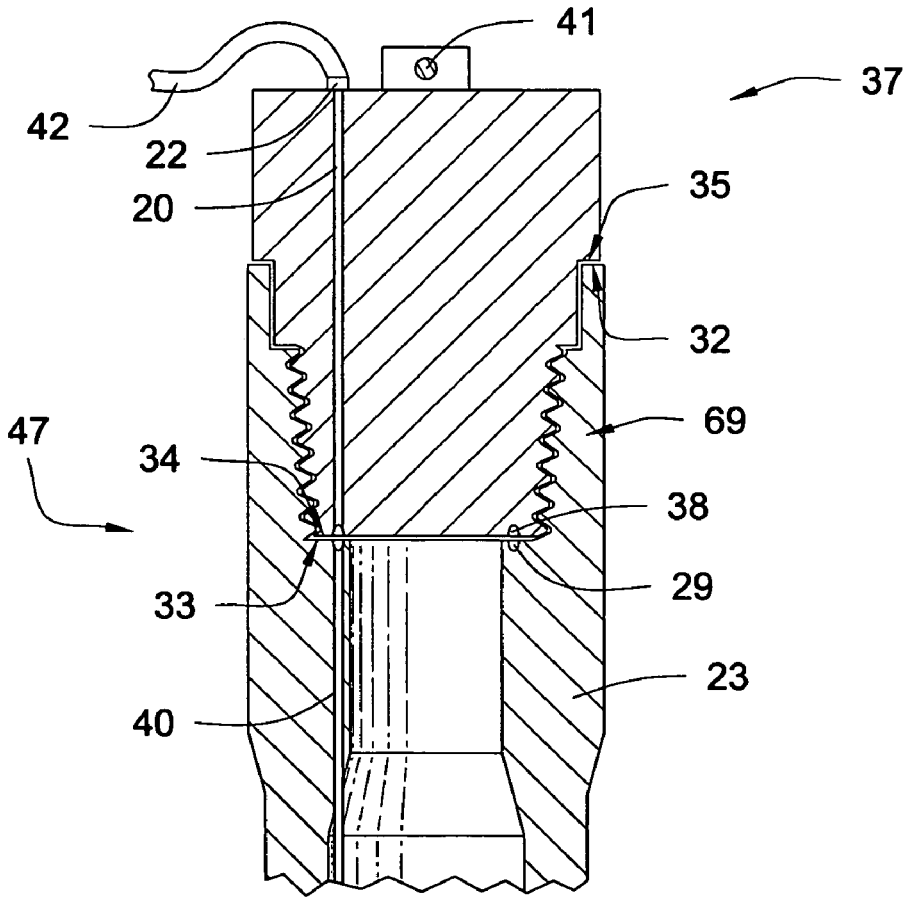
FIG. 3 is a cross sectional view of FIG. 2 attached to a drilling component.

In the embodiment illustrated in FIGS. 2 and 3, the communication adapter 37 attaches to the box end 47 of the drilling component 23. Communication between adapter 37 and drilling component 23 is preferably established by means of a transmission coupler 38 that cooperates with transmission coupler 29 in drilling component 23. Coupler 38 is preferably an inductive coupler, more preferably a coil embedded in circular trough of magnetically-conductive electrically-insulating material, such as ferrite. The transmission coupler 38 is located in a secondary shoulder 34 of the adapter 37. Other embodiments of transmission coupler 38 may include capacitive couplers or direct electrical couplers.

The mechanical coupler in FIGS. 2 and 3 comprises a threaded portion 39 that engages a threaded portion 69 of the drilling component 23. Close positioning of transmission couplers 38 and 29 is facilitated by bringing primary shoulders 35 and 32 and secondary shoulders 34 and 33 into simultaneous contact. A signal travels through the drilling component's transmission system via a coaxial cable 40 that connects to transmission coupler 29 in the drilling component 23. The signal is transmitted through the transmission coupler 29 of the drilling component to the transmission coupler 38 of the adapter 37. An electrical conductor 20, such as a pair of wires or a coaxial cable is positioned inside the adapter 37 to carry the signal from the transmission coupler 38 to the data interface or connector 22. This in turn connects to a coaxial cable 42 that is adapted to communicate data and power with surface equipment 43. The coaxial cable 42 may be temporarily disconnected so that it does not twist or wrap up when adapter 37 is threaded into place.

A pair of handles 41 is attached to the surface 21 of the communication adapter 37 to facilitate threading of the adapter into the box end 47 of the drilling component 23. Other means to facilitate threading may include wrench flats or a gripping surface. A gripping surface may comprise a knurled surface, grooves, or notches.

Preferably, the data interface or connector 22 is an interface to surface equipment 43, which may communicate with a LAN or a WAN. The data interface communicates with the surface equipment 43 by a means selected from the group consisting of radio waves, acoustic waves, light waves, electrical conductors, and fiber optics. A preferred electrical conductor is a coaxial cable. In other embodiments of the present invention, the surface 21 of the communication adapter 37 is provided with an integral data interface that communicates information directly to crew workers. The integral data interface may comprise at least one light, at least one gauge, at least one speaker, a display screen or other similar devices. In one aspect of the present invention, the adapter is closed and sealed at the non-threaded end, thereby blocking the flow of fluids or gases from the drill string. Alternatively the adapter may be provided with means to regulate the flow of fluids or gases from the drill string.

Figure 4:
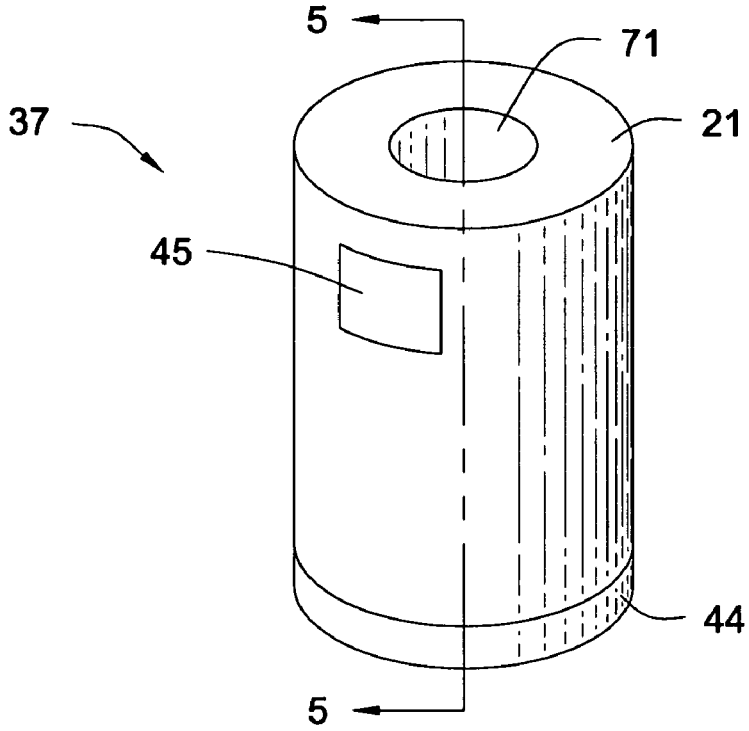
FIG. 4 is a perspective view of an embodiment of a communication adapter.
Figure 5:
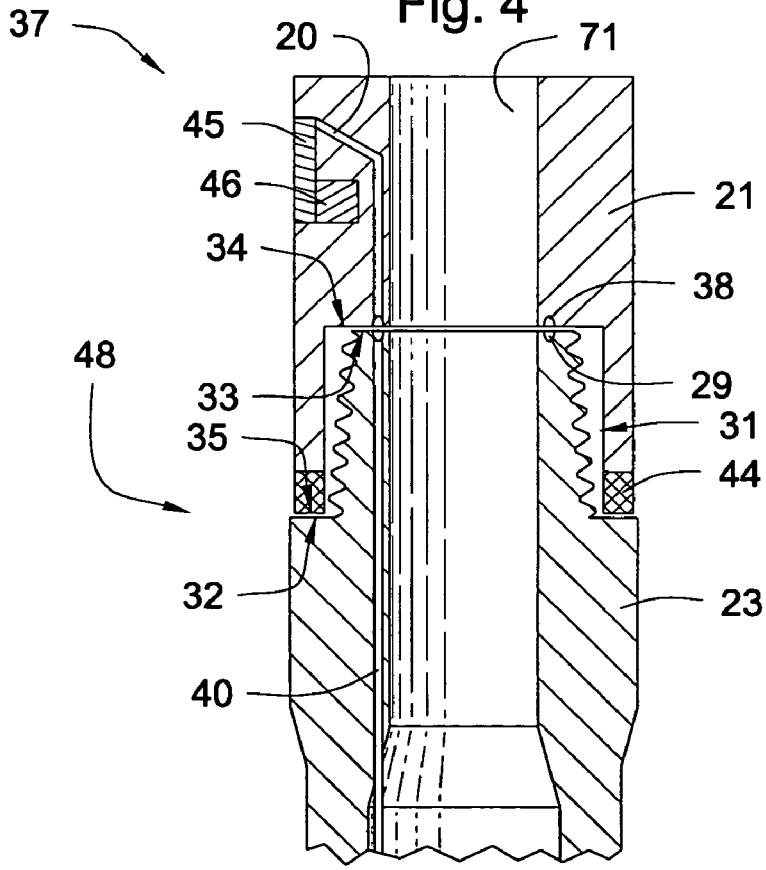
FIG. 5 is a cross sectional view of FIG. 4 attached to a drilling component.

In the embodiment illustrated in FIGS. 4 and 5 a mechanical coupler is adapted to engage the pin end 48 of the drilling component. During drilling, the box end of the drilling component is usually uppermost, but when a component is separated from the drill string it is desirable to couple to both ends of the component. The mechanical coupler of this embodiment comprises at least one magnet 44, and the data interface comprises an integrated data processing unit and display screen 45. A fluid or gas flow may force a communications adapter 37 magnetically coupled to a downhole component 23 off. It is thereby useful to have a passage 71, as shown in FIGS. 4 and 5. In some embodiments the flow of fluids or gases may be regulated with valves or tubes.

In most cases it is preferred that the transmission coupler 38 communicates with surface equipment 43. However, there may be situations where it is desirable to communicate downhole information directly to the crew at the rig floor. One such case might be where a cable 42 might interfere with rig floor operations. Another case might be where the rig crew would need to monitor some downhole condition while manipulating drill string components. Accordingly, the adapter 37 may be provided with a display screen 45 that may contain integral signal conditioning and signal processing circuitry. A battery 46 may be located under the display screen 45. In one embodiment, the display screen is a touch screen, enabling direct two-way communication between the rig crew and the drill string. The adapter 37 is positioned over the threaded portion 31 of the pin end 48 of the drilling component 23. The magnets 44 disposed in the primary shoulder 35 of the adapter 37 hold the adapter against the primary shoulder 32 of the drilling component 23. The magnets should develop sufficient force to hold the communication adapter firmly in place while various operations are performed on the derrick 25, such as lifting of the drill string 23. If inductive couplers are used as the transmission couplers 29 and 38, the magnets should be positioned so as not to interfere with the inductive couplers. Further, some non-magnetic materials are used in steering operations. These non-magnetic materials allow magnetic detectors in the steering equipment to sense the earth's magnetic field without interference or distortion. It is preferred that another mechanical coupler be used in such circumstances.

Preferably the transmission couplers 29 and 38 are housed in recesses in the secondary shoulder 33 of the pin end 48 of the drilling component and in the secondary shoulder 34 of the adapter 37.

In addition to enabling the rig crew to continue to receive needed information from downhole sensors while tripping, the communication adapter may also facilitate measurement of the quality of the communication through the drilling components of the drill string. This can be accomplished prior to inserting the component in the drill string by utilizing two communications adaptors 37, one configured as a box and the other as a pin. Alternatively, the communication adapter 37 may be used to characterize the quality of data transmission in the integrated downhole transmission system. By sending diagnostic tones the transmission line characteristics of the integrated transmission system may be determined, such as attenuation and dispersion. These characteristics can then be transmitted to a downhole data repeater and to the surface equipment for use by adaptive modems. This information can also be utilized while tripping in to determine the optimum placement of repeaters as additional components are added to the drill string.

The communication adapter 37 may also facilitate transmission of power to the various tools on the drill string 49 in addition to facilitating control of these tools. Control and power can be provided through adapter 37 either from surface equipment 43 or from control and power components integral with adapter 37. The communication adapter 37 may alternatively be provided with an embedded, programmable processor that will automatically control certain tools of the drill string 49 when conditions fall within certain pre-determined parameters. For example a communication adapter provided with such a processor may automatically command one downhole tool to take a measurement and may then command a second downhole tool to take a certain action in response to this data. Such a response may be programmed to proceed without need for attention or intervention of the rig crew. The communication adapter 37 may also monitor the health of the entire downhole integrated network and may send commands to optimize communication along the entire system.

In the most preferred embodiment, where the communication adapter 37 communicates with surface equipment 43, a coaxial cable or an optical fiber cable may be utilized. When a cable is used, the cable needs to be secured in such a manner that it will not interfere with the movements of the rig crew and so that it will not catch in the derrick. The cable may be conveniently anchored at a point part-way up the mast so that is overhead during most rig floor operations. During tripping two adapters 37 can be provided, each connected via a separate cable to the surface equipment. One adaptor can ride the top of the string as the elevator 26 lifts the entire string up into the rig. When the drill string 49 is then lowered into the slips 27 and a stand is disconnected from the string, the second adapter can be immediately positioned above the slips on the uppermost drilling component. The first adapter is then returned to the rig floor. By alternating adapters in this fashion, communication with the drill string can be maintained almost continuously. The surface equipment can be configured to automatically switch to whichever adapter is receiving signals from the drill string.

As an alternative to using cables, the communication interface 37 may communicate with surface equipment 43 via microwaves, radio waves, acoustic waves, or light waves, including infrared waves. By such means cables may be eliminated. In this case the communication adapter 37 would be provided with appropriate integral means for signal conditioning and transmitting, and corresponding means would be provided near the surface equipment.

Figure 6:
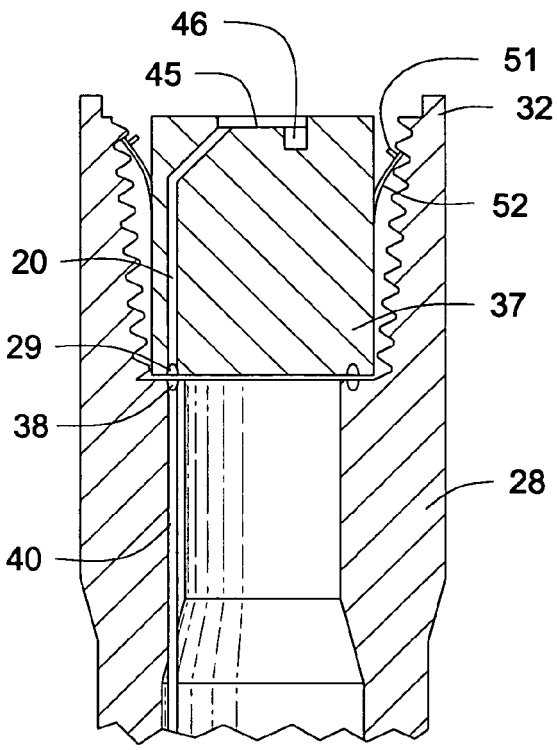
FIG. 6 is a cross sectional view of an embodiment of an adapter attached to a drilling component.

In another embodiment of the present invention, the mechanical coupler comprises at least one locking mechanism, as illustrated in FIG. 6. The locking mechanism comprises a resilient clip 52 that engages the threads 69 inside the box end 28 of the drilling component. A grip 51 is attached to the clip, enabling a worker to pull the clip away from the threads, thereby facilitating removal of the adapter. The clips 52 may have an arcuate shape and are spring-loaded, so that they engage threads 69 when the communication adapter 37 is inserted into the box end of the drilling component. The adapter is thereby rapidly secured. One or two clips 52 may accomplish the intended task, but three or more clips are preferred.

Figure 7:
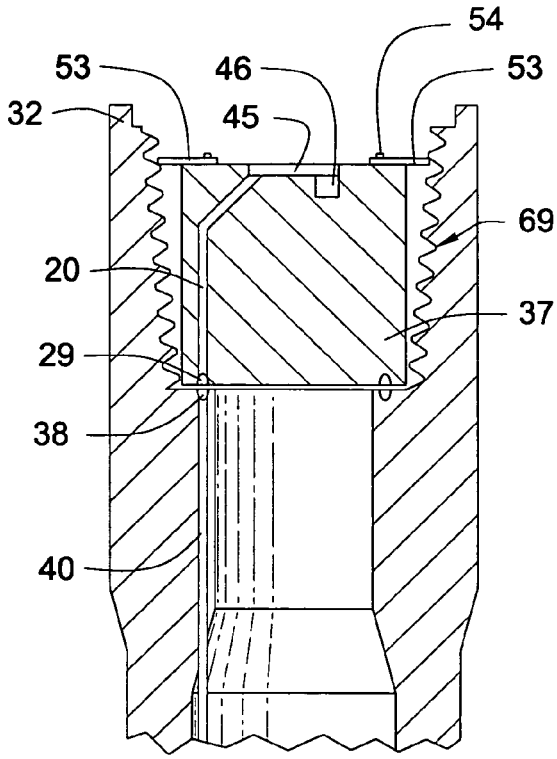
FIG. 7 is a cross sectional view of an embodiment of an adapter attached to a drilling component.
Figure 8:
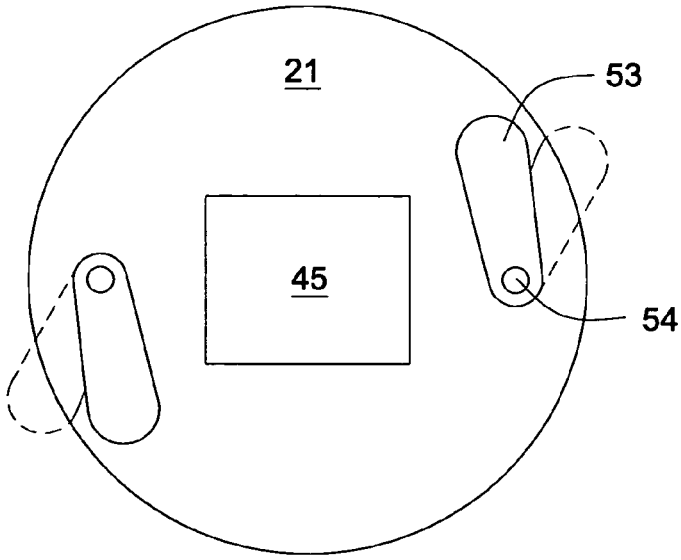
FIG. 8 is an orthogonal view of an embodiment of a communication adapter.

Referring to FIGS. 7 and 8, another embodiment of a mechanical coupler comprises a cam 53. At least one cam is required, but two or more cams are preferred. The cam 53 rotates on a pivot 54 that is attached to the surface 21 of the adapter 37. When rotated outward they engage the threads 69 of the box end 47 of the drilling component. The size and shape of the cam may be adjusted for optimal engagement of the threads.

Figure 9:
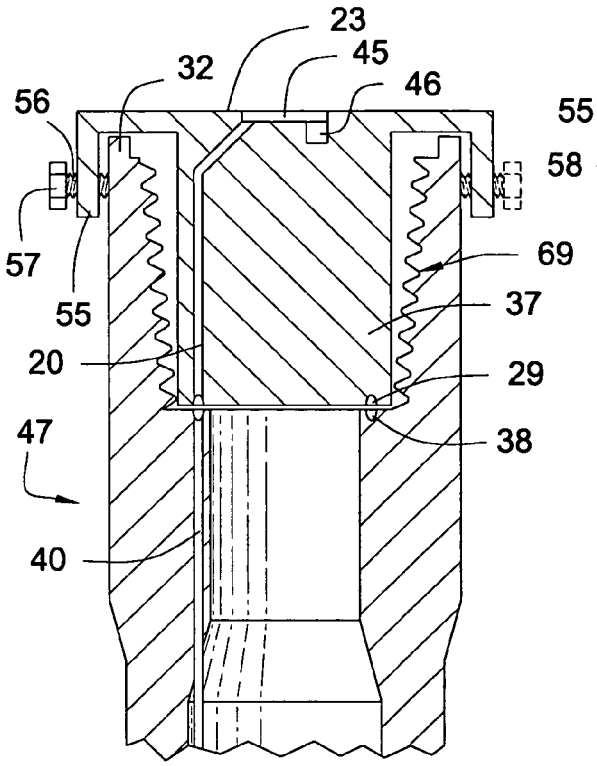
FIG. 9 is a cross sectional view of an embodiment of an adapter attached to a drilling component.

Referring to FIG. 9, another embodiment for mechanically coupling the communications adaptor to a drilling element comprises at least one clamp. In this embodiment a rigid skirt 55 hangs over the primary shoulder 32 of the box end 47 of the drilling component. The skirt may be integral with the upper surface of the communication adapter, or it may be fastened to it by suitable means. A screw 56 clamps the communication adapter 37 into place. At least one screw 56 is desired, but two or more screws are preferred. Torque may be applied to the head 57 of the screw 56 by hand or with a tool such as a wrench or a screwdriver.

Figure 10:
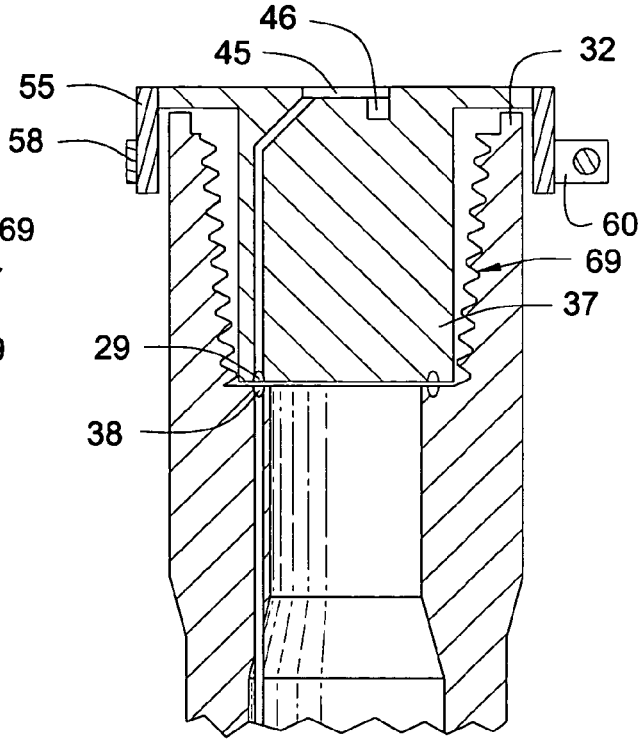
FIG. 10 is a cross sectional view of an embodiment of an adapter attached to a drilling component.
Figure 11:
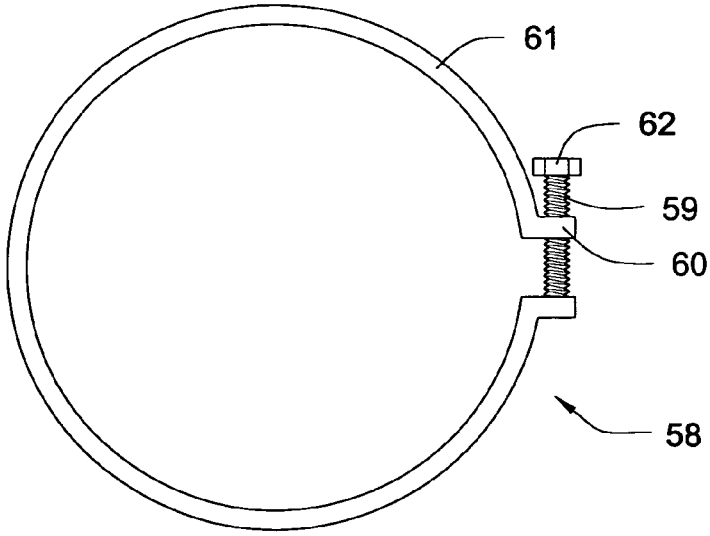
FIG. 11 is an orthogonal view of a mechanical coupler.

Referring to FIGS. 10 and 11, a communication adapter 37 comprises a flexible skirt 55 that is firmly attached to the adapter. The skirt has an inside diameter that is slightly greater than the outside diameter of the primary shoulder 32 of the box end 47 of the drilling component. A circular clamp 58 is provided that has an inside diameter slightly larger than the outside diameter of the skirt. A screw 59 tightens the clamp, which in turn cinches the skirt against the drilling component, thereby holding the adapter firmly in place.

Figure 12:
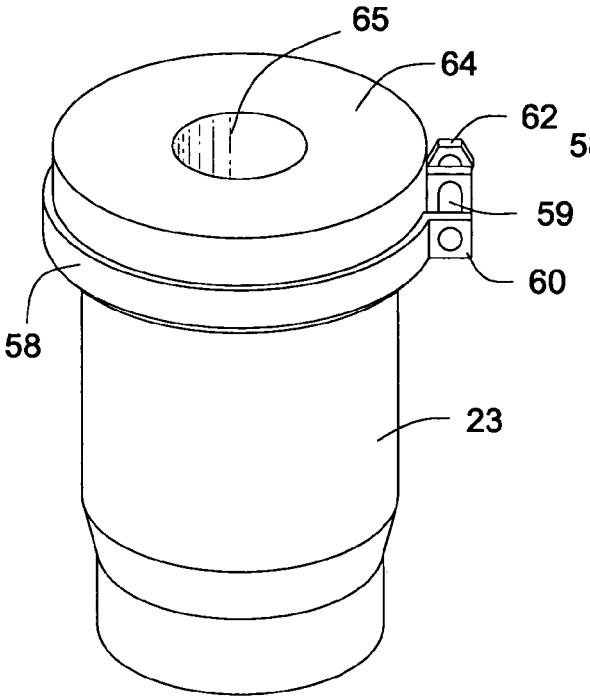
FIG. 12 is a perspective view of an embodiment of an adapter attached to a drilling component.
Figure 13:
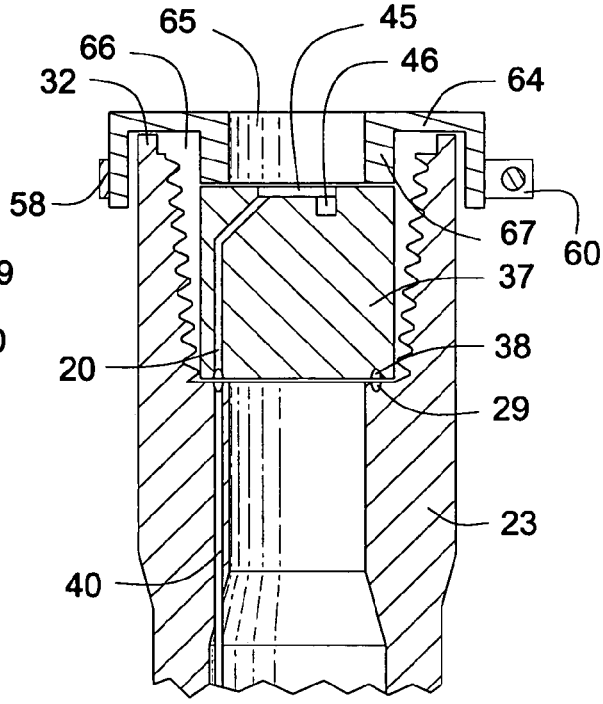
FIG. 13 is a cross sectional view of FIG. 12.

Referring to the embodiment of FIGS. 12 and 13, a cover 64 is placed over the communication adapter 37 and pushes down on the adapter to secure it. A circular clamp 58 is used to attach the cover 64 and the communication adapter 37 to the drilling component 23. An opening 65 facilitates direct communication with the rig crew, such as by means of a display screen 45, or by means of lights, speakers, or gauges. The display screen 45 may comprises a touch screen.

Figure 14:
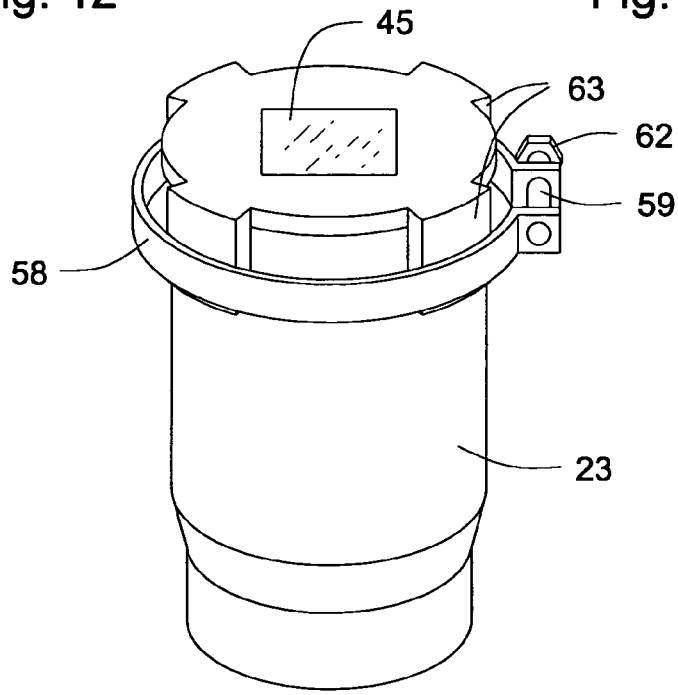
FIG. 14 is a perspective view of an embodiment of a communication adapter attached to a drilling component.

In the embodiment of FIG. 14, flexible tabs 63 extend from the upper surface of the communication adapter 23. A slight gap, not shown, is provided between the inside surface of each tab and the outside diameter of the communication adapter. The circular clamp 58 applies tension to the tabs 63, thereby securing the communication adapter 23.

Figure 15:
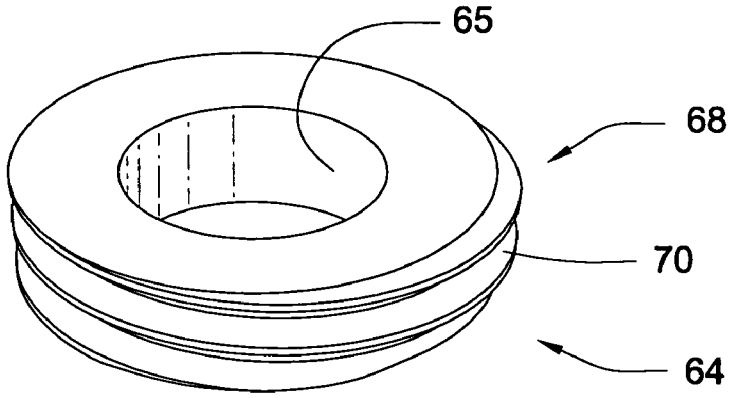
FIG. 15 is a perspective view of an embodiment of a mechanical coupler.
Figure 16:
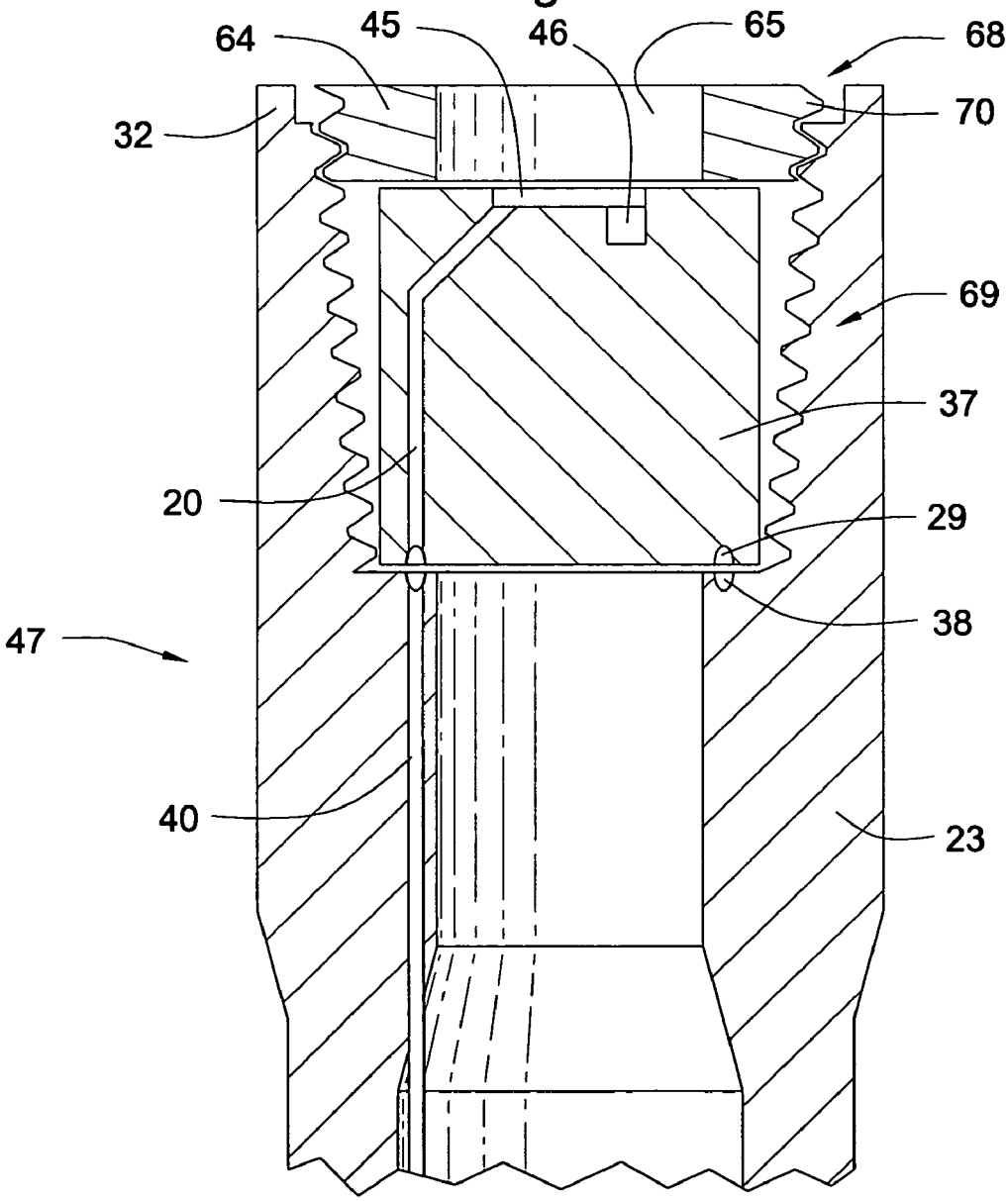
FIG. 16 is a cross sectional view of FIG. 15 attached to a drilling component.

FIGS. 15 and 16 illustrate another embodiment of a cover 64 for the communication adapter 37. The cover may comprise an opening 65. An outer periphery 68 comprises threads 70 that engage the threads 69 of the box end 47 of the drilling component 23. The cover 64 is threaded directly over the communication adapter 37 and holds it in place. The cover 64 should comprise means, not shown, to facilitate threading it into place, such as a pair of handles, grooves, notches, external or internal wrench flats, or a knurled surface.

During tripping the drill string is lowered and raised as components of the drill string are added and removed. In most cases it is preferred that the communication adapter remains connected to the uppermost drilling component until the stand to which it belongs is removed from the drill string. In some cases it may be necessary to rotate the drill string as it is removed from the well bore. This is readily accomplished when the communication adapter communicates with the surface equipment by means of microwaves, radio waves, light waves, or acoustic waves. When a cable 42 is used to communicate with the surface equipment 43, a rotating connection may be provided so as to prevent twisting of the cable or wrapping of the cable around the drill string. The rotating connection may comprise slip rings or an inductive coupler.

The drilling components 23 that are connected to the drill string 49 may comprise a drill pipe, a heavyweight drill pipe, a drill collar, a stabilizer, a kelly, or any downhole tool. Examples of downhole tools include mud motors, turbines, jars, communications repeaters, mud hammers, shock absorbers, reamers, under-reamers, fishing tools, steering elements, MWD tools, LWD tools, seismic sources/receivers and other such devices.

The communication adapter is preferably capable of transmitting both data signals and power. The communication adapter 37 may also seal to the uppermost component of the drill string and may be provided with means to prevent or regulate the escape of fluids or gases from the string.

What is claimed is:

1. A communication adapter for removable attachment to a drilling component when the drilling component is not actively drilling and for communication with an integrated transmission system in the drilling component, the communication adapter comprising:

a data transmission coupler for allowing data communication between the drilling component and the adapter;

a mechanical coupler for removably attaching the adapter to the drilling component; and a data interface comprising a display screen, a gauge, a speaker or a light.

2. The communication adapter of claim 1 wherein the drilling component is attached to a drill string.

3. The communication adapter of claim 1 wherein the data interface is an interface to surface equipment.

4. The communication adapter of claim 3 wherein the surface equipment connects to a local area network or a wide area network.

5. The communication adapter of claim 3 wherein the data interface communicates with the surface equipment by means selected from the group consisting of microwaves, radio waves, acoustic waves, light waves, electrical conductors, and fiber optics.

6. The communication adapter of claim 1 wherein the transmission coupler is an inductive coupler.

7. The communication adapter of claim 6 wherein the inductive coupler comprises ferrite.

8. The communication adapter of claim 1 wherein the transmission coupler is a direct electrical coupler.

9. The communication adapter of claim 8 wherein the direct electrical coupler comprises a metal-to-metal connection.

10. The communication adapter of claim 1 wherein the mechanical coupler comprises a threaded portion that engages a threaded portion on the drilling component.

11. The communication adapter of claim 1 wherein the mechanical coupler comprises a locking mechanism.

12. The communication adapter of claim 1 wherein the mechanical coupler comprises a magnet.

13. The communication adapter of claim 1 wherein the mechanical coupler comprises a cam.

14. The communication adapter of claim 1 wherein the mechanical coupler comprises a clamp.

15. The communication adapter of claim 1 wherein the mechanical coupler is adapted to couple to the pin end of the drilling component.

16. The communication adapter of claim 1 wherein the mechanical coupler is adapted to couple to the box end of the drilling component.

17. The communication adapter of claim 1 wherein the communication adapter is capable of transmitting power.

18. The communication adapter of claim 1 wherein the communication adapter is capable of transmitting data.

19. The communication adapter of claim 1 wherein the adapter seals to the drilling component and is provided with means to prevent or to regulate the flow of fluids or gases from the drilling component.

20. A communication adapter for removable attachment to a drilling component when the drilling component is not actively drilling and for communication with an integrated transmission system in the drilling component, the communication adapter comprising:

an inductive coupler for facilitating data communication between the drilling component and the adapter;

a mechanical coupler for removably attaching the adapter to the drilling component; and a data interface comprising a display screen, a gauge, a speaker or a light.

21. The communication adapter of claim 20 wherein the drilling component is attached to a drill string.

22. The communication adapter of claim 20, wherein the surface equipment communicates with a local area network or with a wide area network.

23. The communication adapter of claim 20 wherein the interface communicates with the surface equipment by means selected from the group consisting of microwaves, radio waves, acoustic waves, light waves, electrical conductors, and fiber optics.

24. The communication adapter of claim 20 wherein the inductive coupler comprises ferrite.

25. The communication adapter of claim 20 wherein the mechanical coupler comprises a threaded portion that engages a threaded portion on the drilling component.

26. The communication adapter of claim 20 wherein the communication adapter is capable of transmitting power.

27. The communication adapter of claim 20 wherein the mechanical coupler comprises a locking mechanism.

28. The communication adapter of claim 20 wherein the mechanical coupler comprises a magnet.

29. The communication adapter of claim 20 wherein the mechanical coupler comprises a cam.

30. The communication adapter of claim 20 wherein the mechanical coupler comprises a clamp.

31. The communication adapter of claim 20 wherein the mechanical coupler is adapted to couple to the pin end of the drilling component.

32. The communication adapter of claim 20 wherein the mechanical coupler is adapted to couple to the box end of the drilling component.

33. The communication adapter of claim 20 wherein the adapter seals to the drilling component and is provided with means to prevent or to regulate the flow of fluids or gases from the drilling component.

* * * * *